US008210919B2

(12) United States Patent
Sarabi

(10) Patent No.: US 8,210,919 B2
(45) Date of Patent: Jul. 3, 2012

(54) CARD GAME WITH A NON-INTEGER NUMERICAL TARGET

(75) Inventor: Ron M. Sarabi, Huntington Beach, CA (US)

(73) Assignee: Hawaiian Gardens Casino, Hawaiian Gardens, CA (US)

( * ) Notice: Subject to any disclaimer, the term of this patent is extended or adjusted under 35 U.S.C. 154(b) by 608 days.

(21) Appl. No.: 12/419,740

(22) Filed: Apr. 7, 2009

(65) Prior Publication Data

US 2010/0255895 A1 Oct. 7, 2010

(51) Int. Cl.
*A63F 9/24* (2006.01)

(52) U.S. Cl. ..... 463/11; 463/13

(58) Field of Classification Search ..... 463/11, 463/12, 22; 273/274, 292
See application file for complete search history.

(56) References Cited

U.S. PATENT DOCUMENTS 4,659,087 A * 4/1987 Shen et al. ..... 273/274
5,314,193 A * 5/1994 Ferrer ..... 273/292
5,397,128 A 3/1995 Hesse
5,725,215 A 3/1998 Hesse
7,264,243 B2 * 9/2007 Yoseloff et al. ..... 273/292

OTHER PUBLICATIONS

QFIT, Unusual Blackjack Games, http://qfit.com/blackjack-games-variations.html, accessed Oct. 24, 2005, 4 pages.
Hustler Casino, How to Play Hustler Casino Games, http://hustlergaming.com/player_center/baccarat.html, accessed Nov. 9, 2007.
Barona Valley Ranch Resort & Casino, Cash Baccarat, http://www.barona.com/casino/cash-baccarat.html, accessed Nov. 9, 2007.
Gambling Baccarat.com, American Baccarat Rules, http://www.gambling-baccarat.com/american_baccarat.htm, accessed Nov. 9, 2007.
Commerce Casino, 21st Century Baccarat, http://www.commercecasino.com/gameDetails.aspx?gameId=30&game, accessed Nov. 9, 2007.
Hollywood Park Casino, 21st Century Baccarat, http://www.playhpc.com/baccarat.php, accessed Nov. 9, 2007.
* cited by examiner

*Primary Examiner* — Brook Kebede
(74) *Attorney, Agent, or Firm* — SoCal IP Law Group LLP; John E. Gunther; Steven C. Sereboff

(57) ABSTRACT

There is disclosed a method of playing a numerical target card game. After bets are accepted from at least one player, one card may be dealt to the player and a banker. The player may elect to receive one or more hit cards. The banker may receive one or more hit cards according to predetermined rules. If the player receives a hand having a value greater than a numerical target, the player loses. If the value of the banker's hand exceeds the numerical target, every player receiving a hand with a value less than or equal to the numerical target wins. When the values of the banker's hand and the player's hand are both less than or equal to the numerical target, the hand with the highest value wins and the hand is a tie if the value of the banker's hand and a player's hand are equal.

35 Claims, 4 Drawing Sheets

| Numerical Target | 9.5 |
|---|---|
| Card Values | |
| Acc | 1 |
| Two | 2 |
| Three | 3 |
| Four | 4 |
| Five | 5 |
| Six | 6 |
| Seven | 7 |
| Eight | 8 |
| Nine | 9 |
| Ten | ½ |
| Jack | ½ |
| Queen | ½ |
| King | ½ |
| Banker hit rules | Must hit 5½ or less; must stand on 6 or more |

FIG. 2A

| Hand Rank | Hand Value | Payout |
|---|---|---|
| Highest | 9½ | 3:2 |
| 2nd | 9 | 1:1 |
| 3rd | 8½ | 1:1 |
| 4th | 8 | 1:1 |
| 5th | 7½ | 1:1 |
| 6th | 7 | 1:1 |
| 7th | 6½ | 1:1 |
| 8th | 6 | 1:1 |
| 9th | 5½ | 1:1 |
| 10th | 5 | 1:1 |

FIG. 2B

| Numerical Target | 10.5 | 8.5 |
|---|---|---|
| Card Values | | |
| Ace | 1 | 1 |
| Two | 2 | 2 |
| Three | 3 | 3 |
| Four | 4 | 4 |
| Five | 5 | 5 |
| Six | 6 | 6 |
| Seven | 7 | 7 |
| Eight | 8 | 8 |
| Nine | 9 | See notes |
| Ten | 10 | ½ |
| Jack | ½ | ½ |
| Queen | ½ | ½ |
| King | ½ | ½ |
| Banker hit rules | Must hit 6 or less; must stand on 6½ or more | See notes |

Notes (for game with numerical target of 8½):

a. A nine may be evaluated as 9, in which case a player dealt an initial nine automatically busts. The banker must hit 4½ or less and stand on 5 or greater.

b. A nine may be evaluated as ½. The banker must hit 5½ or less and stand on 6 or greater.

c. The nines may be removed from the decks. The banker must hit 5 or less and stand on 5½ or greater.

FIG. 3

CARD GAME WITH A NON-INTEGER NUMERICAL TARGET

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to card games which are particularly suitable for use in gaming establishments.

2. Description of the Related Art

The object of several popular gambling card games is to receive a hand that, when the values of the cards in the hand are summed, is close to a predetermined numerical target. In baccarat, the object is to receive a hand that totals 9. In blackjack, the object is to receive a hand that totals 21. Within this patent, the value of a card or a hand will be indicated by numerals, and the words "two" through "ten" will be used to indicate the denomination of a card.

In baccarat, only a player hand and a banker hand are dealt and all of the participants wager that either the player hand or the banker hand will be closer to 9. The player hand is dealt two cards face up and the banker hand is dealt one card face down and a second card face up. The player hand and the banker hand then may each receive a third card in accordance with predetermined rules. The score of a hand is calculated by taking the sum of the values of all cards modulo 10. Simply, when the total value of cards in a hand equals or exceeds 10, the tens digit is dropped. In baccarat, aces have a value of 1, numbered cards cards two to nine have face value, and tens and face cards (jacks, queens, kings) have a value of zero. For example, a hand consisting of a two and a three has a value of 5 ($2+3=5$). A hand consisting of a six and a seven has a value of 3 ($6+7=13\equiv3$)—the first digit is dropped because the total is higher than 10. A hand consisting of a four and a six is worth zero ($4+6\equiv0$). The highest score that can be achieved is 9.

In blackjack, each of a plurality of players plays against a common banker. Each player is dealt two cards face up and the banker is dealt one card face down and a second card face up. The players, in rotation, may elect to receive one or more cards. When all of the players have completed their hands, the banker may receive one or more cards in accordance with predetermined rules. The score of a hand is calculated by taking the sum of the values of all cards. Aces have a value of 1 or 11, numbered cards two to ten have face value, and face cards have a value of ten. Commonly, a player having a hand totaling more than 21 loses regardless of the final value of the banker hand. A player having a hand totaling less than 21 wins if the banker's hand totals more than 21, or if the player's hand is closer to 21 than the banker's hand. Variations of blackjack played in card rooms may provide for the player to tie or win with some hands totaling over 21.

In a casino, the banker, who may also function as the dealer, may be an employee playing on behalf of the establishment. Alternatively, in a "card room" game each player may have the option to act as banker, or the banker may be a licensed third-party service provider or the banker may be a player trust or pool fund. The card room establishment may provide a dealer to manage the game and collect fees from the players.

Players typically enjoy games which can be played rapidly and which offer players some degree of participation or require some degree of skill.

DESCRIPTION OF THE DRAWINGS

FIG. 2A is a table listing some of the rules for a card game with a non-integer numerical target.

FIG. 2B is a table listing the rankings of various hands in a card game played using the rules of FIG. 2A.

FIG. 3 is a table listing some of the rules for two variations of a card game with a non-integer numerical target.

DETAILED DESCRIPTION

Throughout this description, the embodiments and examples shown should be considered as exemplars, rather than limitations on the apparatus and methods disclosed or claimed.

Description of Processes

A card game with a non-integer numerical target (hereinafter "the game") may be played using one or more (commonly four, six, or eight) conventional 52-card decks of playing cards. The game may be played by a dealer, a banker, and at least one additional player. The dealer and the banker may, in some circumstances, be the same person, or may be a computing device. One or more of the additional players may also be a computing device.

The objective of the game may be, like blackjack, to receive a hand equal to, or as close to, a predetermined numerical target as possible without exceeding the value of the numerical target. Unlike blackjack, the numerical target of the game may be an integer plus a fractional value, where a "fractional value" is broadly defined as any rational or irrational positive number greater than zero and less then one. In further contrast to blackjack, the game may begin with each player receiving an initial hand of one card, and the values assigned to the cards may be defined such that the numerical target cannot be achieved by an initial single-card hand.

When the game is played in a casino, the dealer and banker may be a single person who is employed by the casino and who plays on behalf of the casino. When the game is played in a card club, the banker may be one of the players participating in the game or a licensed third-party service provider. The roll of the banker may rotate among the players, with each player being the banker for a fixed number of hands. When the game is played in a card club, the dealer may be an employee of the card club establishment who supervises the game and collects fees or commissions for the establishment.

The game can be played on any surface that allows the cards to be shuffled and dealt. A casino or card club may provide a specialized table having markings that define the player locations and the positions on the table for the players to place their bets and collections.

Figure 1:
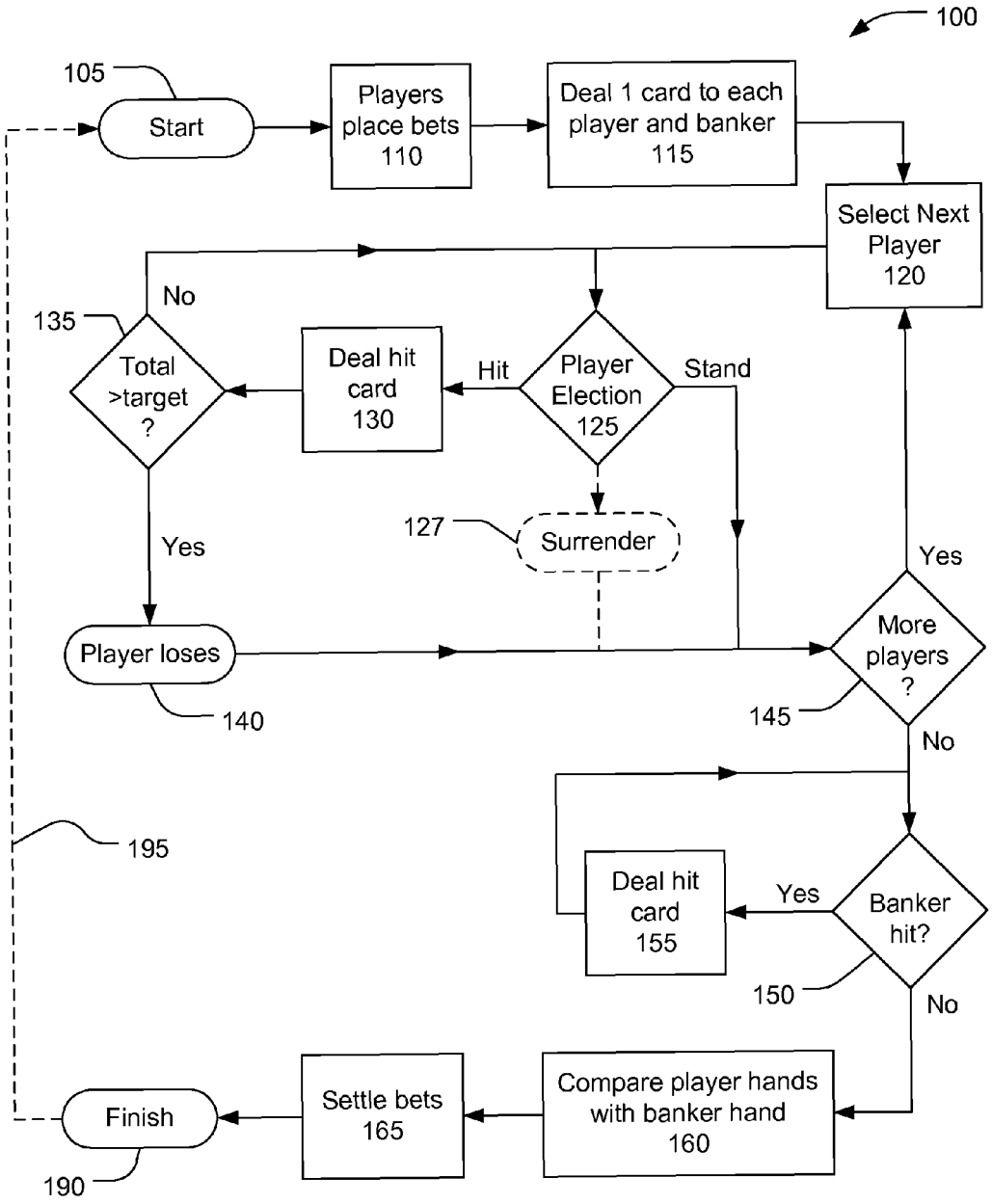
FIG. 1 is a flow chart of a method of playing a card game.

Referring now to FIG. 1, a flow chart of a method for playing the game begins at 105 and finishes at 190. It must be understood that the process is cyclic. A completed hand may be followed by another hand, as indicated by the dashed arrow 195, and this may occur in rapid succession.

At 110, each player, including the banker when the game is played in a card club, may place a bet in accordance with predetermined limits. The predetermined limits may define, for example, a minimum bet to participate in the game and a maximum allowable bet. When the game is played at multiple tables in an establishment, the predetermined limits may be the same or different at each of the tables. The rules of the game may require all bets be placed before any cards are dealt.

After all bets are placed, at 115 the dealer may deal one card face up to each player and one card face down to the banker. The card dealt face down may be referred to as the "banker's hole card" or the "hole card".

After the initial cards are dealt, the players may, in sequence, complete their hands. At 120, a first player, who may for example be the player to the left of the dealer, may be selected. At 125, the dealer may request the selected player to make an election to either stand with the single card they were dealt at 115 or to receive an additional card. To make this election, the player may evaluate their hand with respect to a predetermined numerical target of the game.

FIG. 2A lists some of the rules for an exemplary embodiment of the game which will be used to explain the method of playing the game. In this exemplary embodiment, the predetermined numerical target is 9½, which is to say the objective of the exemplary embodiment is to receive a hand having a value as close to 9½ as possible without exceeding 9½. The total value of a player's or banker's hand is the sum of the values of the individual cards, with each ace counted as one, each numbered card two to nine counted at face value, and each ten and each face card counted as ½.

Referring back to FIG. 1, at 125 the selected player may compare the value of their hand (initially a single card) to the numerical target of 9½ (in this example) and elect to stand or to receive an additional card. Since the numerical target is this example is 9½ and the highest card value is 9, the value of the player's original one-card hand cannot exceed the numerical target. The player may elect, for example, to receive an additional card if the value of their hand is small compared to the numerical target and may elect to stand if the value of their hand is close to the numerical target. The election to receive an additional card in blackjack is commonly called "taking a hit" and that terminology will be used herein.

As an optional feature of the game, the player may be allowed to surrender at 125. A player who elects to surrender forfeits one-half of their bet and withdraws from the hand at 127. The election to surrender may be available only on the initial one-card hand and may be limited to specific hand values. When the numerical target is 9½, the player may be allowed to surrender, for example, only if their initial card is a five, if their hand has a value of four or five, if their hand has a value of four to six, or if the value of their hand falls within some other predetermined range of values.

When the player elects to take a hit, a single additional card is dealt to the player at 130 and the value of the player's hand is reevaluated at 135. If at 135 the value of the player's hand, including any hit cards, exceeds the numerical target of 9½, the player "busts" and loses their bet at 140 regardless of the eventual value of the banker's hand. If the value of the player's hand at 135, including any hit cards, is less than the numerical target, the process returns to 125 where the player must again elect to stand or to take an additional hit. The process 100 repeats the actions at 125, 130 and 135 cyclically until the selected player either busts at 140 or elects to stand at 125.

When the selected player surrenders, busts or stands, their hand is completed and the process proceeds to 145 to determine if any additional players need to complete their hands. The process cycles through the actions from 120 to 145 until all players have completed their hands.

When all players have completed their hands, the banker's hole card may be exposed at 150 and a determination may be made if the banker's hand will take a hit. Unlike the player hands, the determination if the banker's hand will take a hit may be based on predetermined banker hit rules rather than an election on the part of the banker. In the example rules of FIG. 2A, the banker's hand must take a hit if the value of the banker hand is 5½ or less and must stand if the value is 6 or more. The process repeats cyclically through 150 and 155 until the value of the banker's hand is completed, which is to say that the value of the banker's hand (in this example) is 6 or greater.

When the banker's hand is completed, the hands of the remaining players who did not bust at 140 are compared to the banker's hand at 160 and remaining bets are settled at 165. The ranking of the highest hands are listed in FIG. 2B for reference. If the value of the banker's hand exceeds the numerical target, all remaining players win and receive a payout equal to the amount of their bet, or even money. If the banker's hand is less than or equal to the numerical target, each remaining player wins if the value of their hand is greater than the value of the banker's hand. Each remaining player loses and forfeits their bet if the value of the player's hand is less than the value of the banker's hand. The hand is a draw or push and the player retains their bet if the value of the player's hand and the banker's hand are equal. All winning players may receive a payout equal to the amount bet. To increase interest in the game, players who win with a hand value equal to the numerical target may receive a higher payout, such as 3:2 on their bet. All bets may be made between the players and the banker, such that the banker pays the winning players and the banker receives all bets forfeited by the players.

When the roll of banker is filled by one of the players, the player-banker may have a finite "stake", or amount of money that he is willing or able to risk on any given hand. In this case, the banker's stake may be smaller than the total amount wagered by the other players participating in the game, and the banker may not be able to "cover", or pay off, all of the bets made by the other players. To ensure fairness, the "action", or settlement of wagers, may start with a different player on each hand and proceed in a predetermined order, such as clockwise, around the table until the accumulated total of the bets made equals or exceeds the banker's stake. Players whose bets are not covered by the dealer's stake receive "no action", which is to say that they retain their original wager regardless of how they bet or the values of the hands.

The position on the table where the settlement of wagers begins may be designated by a marker, commonly called an "action button". The position of the action button may move progressively around the table, or may be set randomly for each hand. For example, the dealer may roll dice at the start of each hand to determine the location of the action button for that hand. Alternatively, the position of the action button may be determined by the value of the banker's hole card.

For example, the table where the game is played may have positions for eight players, one of whom may be acting as the player-banker. If the banker's hole card is an ace or an eight, the action button may be placed in front of the player to the player-banker's left. If the banker's hole card is a two or a nine, the action button may be placed in front of the second player to the player-banker's left. This process may be extended for the remaining cards such that the action button may be placed in front of the player to the player-banker's right if the hole card is a king.

The game may proceed in a different sequence from that shown in the flow chart of FIG. 1. A different sequence may require that all bets are placed before the initial one-card hands are dealt, that all bets are settled before the next hand begins, and that all players complete their hands before the banker's hole card is exposed.

The game may be played with a predetermined numerical target other than 9½. FIG. 3 shows some of the rules for variations of the game in which the numerical target is 10½ and 8½. The game variation with a numerical target of 10½ is similar to the game with a numerical target of 9½ except that tens are evaluated as 10, and the banker must hit any hand with a value of 6 or less.

A game with a numerical target of 8½ may be played according to several different sets of rules depending on the value given to a nine. In a first variation, nines may be evaluated as 9. Since 9 is greater than the numerical target of 8½, a player or dealer who is initially dealt a nine would bust without having the option to take a hit. This feature may be unattractive to potential players. In a second variation, the nines may simply be removed from the decks of cards. In a third variation, the nines, like the tens and face cards, may be evaluated as ½. Similar alternatives exist for even lower numerical target values. In all cases, the rules of the game may provide that cards having a face value higher than the numerical target may be assigned a fractional value or that cards having face value higher than the numerical target may be removed from the decks.

The numerical target may be an integer plus a fractional value. In the example rules of FIG. 2A and FIG. 3, the fractional value is ½ and each game has a numerical target equal to an integer plus ½. However, the game may be played with any non-integer numerical target. Note that the game played with a numerical target greater than 9½ and less than 10 would be essentially identical to the game with a target of 9½ except that it would not be possible to receive a hand with a value exactly equal to the numerical target. For example, if the numerical target was 9.6 or 9.99 or any other value greater than 9.5 and less than 10, the best possible hand would still be 9½ and any hand equal to 10 or greater would still bust.

In the example rules of FIG. 2A and FIG. 3, each game had a numerical target equal to an integer plus ½ and each face card (and the tens and nines in some examples) was assigned a value of ½. However, the value assigned to the face cards may be a value other than the fractional portion of the numerical target. For example, in the game with a numerical target of 9½, the best possible hand can be achieved, for example, with a nine and a face card if face cards have a value of ½, or by a nine and two face cards if face cards have a value of ¼. Assigning face cards a value other than the fractional portion of the numerical target may greatly reduce the possibility of receiving a hand exactly equal to the numerical target, and make preclude any two-card hand from having a value equal to the numerical target.

Like blackjack, the game may be played in parallel with a variety of additional wagers in the form of side bets, bonus pools, jackpots, and the like. For example, a player may elect to place a side bet that the banker will bust. The result of such a side bet may be independent of the hand the player receives in the game. For further example, a player may elect to pay a collection to participate in a bonus pool that pays a substantial bonus if the player's hand in the game is equal to the numerical target with all cards being of the same suit.

Description of Apparatus

A card game with a non-integer numerical target may also be played between one or more player and a computing device in the form of a gaming machine. In this case, the computing device may fulfill the roles of both dealer and banker.

Figure 4:
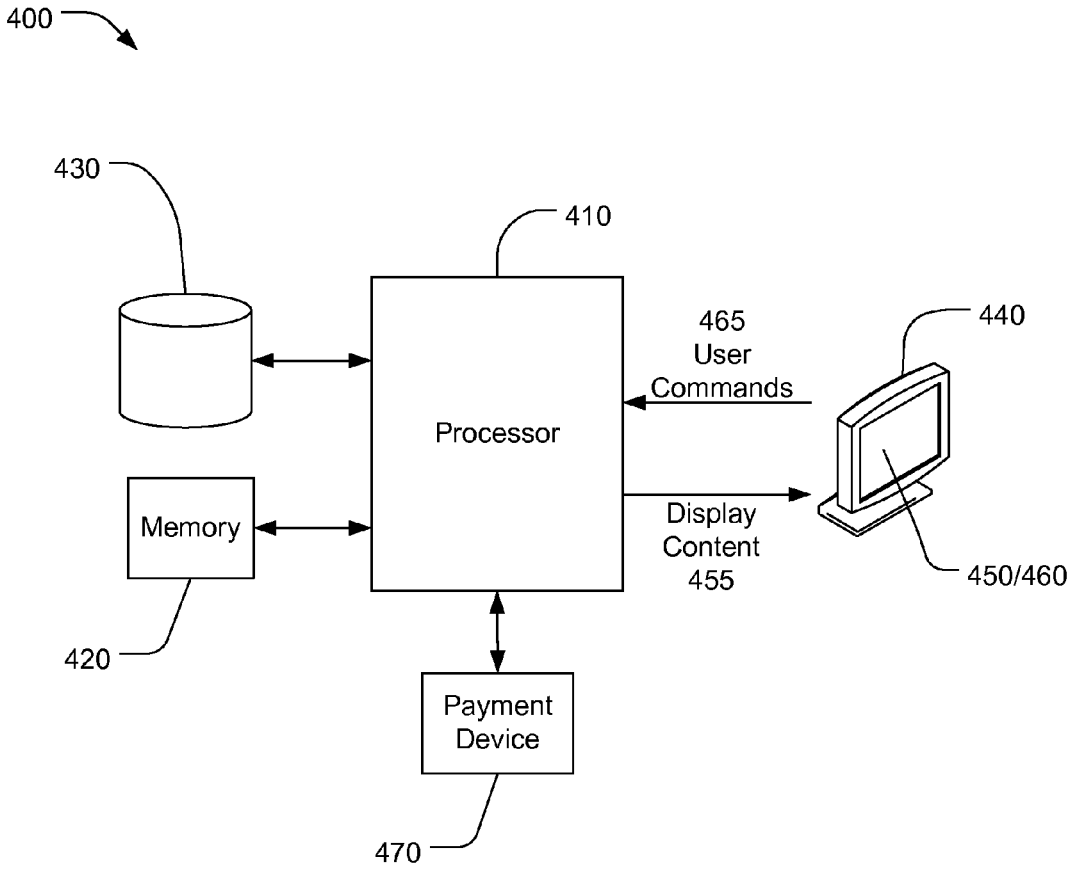
FIG. 4 is a block diagram of a computing device.

Referring now to FIG. 4, a computing device 400 may consist of a processor 410 and a memory 420 coupled to the processor 410. At least one storage device 430 may be coupled to the processor for the storage of data and instructions. As used herein, a storage device is a device that allows for reading and/or writing to a storage medium. These storage media include, for example, magnetic media such as hard disks, floppy disks and tape; optical media such as compact disks (CD-ROM and CD-RW) and digital versatile disks (DVD and DVD±RW); flash memory cards; and other storage media. Storage devices include hard disk drives, DVD drives, flash memory devices, and others.

Computing device 400 may include a user interface 440 that may be used by the one or more players to enter wagers and to elect to receive or not receive a hit card when appropriate. The user interface 440 may commonly be a display panel 450 with a touch-screen data entry device 460. The processor 410 may provide display content 455 to the display panel 450, and may receive user commands 465 from the touch-screen data entry device 460. The computing device 400 may include other user interface devices such as a keyboard, control panel, mouse or other pointing device, and other data entry devices.

Computing device 400 may include or be coupled to a payment device 470 for receiving bets and collections from the at least one player. The payment device may be a receptor for coins, bills, chips, or tokens; may be a financial card reader; or may be some other payment reception mechanism. Payment device 470 or some other device may be capable of providing payouts to the at least one player for winning hands. Payouts may be made in the form of cash, chips, tokens, credit against an account, script, or some other method.

Computing device 400 may perform the processes and steps attributed to the dealer and banker in the game described in FIG. 1. Computing device 400 may receive any bet and/or collection elected by the player. Computing device 400 may include software to simulate the random dealing of hands. The computing device 400 may receive an election to hit or stand from at least one player via the user interface 440. The computing device 400 may evaluate the hands and provide a payout to the player for a winning hand. The computing device 400 may allow a player to bet on more than one hand simultaneously. The player may play all hands. Alternately, the player may play only one hand and the computing device may play the additional hands on behalf of the player using predetermined rules.

Computing device 400 may include software and/or hardware for providing functionality and features described herein. Computing device 400 may therefore include one or more logic arrays, memories, analog circuits, digital circuits, software, firmware, and processors such as microprocessors, field programmable gate arrays (FPGAs), application specific integrated circuits (ASICs), programmable logic devices (PLDs) or programmable logic arrays (PLAs). The hardware and firmware components of the computing device 400 may include various specialized units, circuits, software and interfaces for providing the functionality and features described here. The processes, functionality and features may be embodied in whole or in part in software which operates on a client computer and may be in the form of firmware, an application program, an applet (e.g., a Java applet), a browser plug-in, a COM object, a dynamic linked library (DLL), a script, one or more subroutines, or an operating system component or service. The hardware and software and their functions may be distributed such that some components are performed by a client computer and others by other devices.

The processes and apparatus described herein may be implemented with any computing device. A computing device as used herein refers to any device with a processor, memory and a storage device that may execute instructions including, but not limited to, personal computers, server computers, computing tablets, video game systems, telephones, personal digital assistants (PDAs), portable computers, and laptop computers. These computing devices may run an operating system, including, for example, variations of the Linux, Unix, MS-DOS, Microsoft Windows, Palm OS, Solaris, Symbian, and Apple Mac OS X operating systems.

The computing device 400 may be implemented as hardware, software, firmware, or a combination thereof. Additional and fewer units, modules or other arrangement of software, hardware and data structures may be used to achieve the processes and apparatuses described herein.

Closing Comments

The foregoing is merely illustrative and not limiting, having been presented by way of example only. Although examples have been shown and described, it will be apparent to those having ordinary skill in the art that changes, modifications, and/or alterations may be made.

Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A method of playing a numerical target card game involving a banker and at least one player, the method comprising the steps of:

accepting a bet from the player dealing a player's hand to the player and a banker's hand to the banker, the player's hand consisting of one card face up and the banker's hand consisting of one card face down completing the player's hand, wherein completing the player's hand comprises receiving an election from the player to optionally receive one or more additional cards after the player's hand is completed, completing the banker's hand, wherein completing the banker's hand comprises exposing the card dealt to the banker optionally dealing one or more cards to the banker's hand according to predetermined banker hit rules resolving bets according to the following rules:

if the player receives a hand having a value greater than a predetermined numerical target, the player loses regardless of the value of the banker's hand if the player receives a hand having a value less than or equal to the numerical target and the value of the banker's hand exceeds the numerical target, the player wins when the value of the banker's hand and the player's hand are both less than or equal to the numerical target, the hand with the highest value wins when the value of the banker's hand and the player's hand are equal and less than or equal to the numerical target, the hand is a tie.

2. The method of playing a card game of claim 1, wherein the at least one player is a plurality of players a respective hand is dealt to each of the plurality of players the respective hands of all of the plurality of players are completed before the banker's hand is completed.

3. The method of playing a card game of claim 1, wherein the numerical target is a non-integer value.

4. The method of playing a card game of claim 3, wherein the numerical target is equal to the sum of an integer portion and a fractional portion.

5. The method of playing a card game of claim 4, wherein the value of each hand is the sum of the values of the cards dealt to the hand aces have a value of 1 face cards have a predetermined fractional value numbered cards up to the integer portion of the numerical target have face value.

6. The method of playing a card game of claim 5, wherein the predetermined fractional value is equal to the fractional portion of the numerical target.

7. The method of playing a card game of claim 6, wherein the numerical target is 9½ tens and face cards have a value of ½.

8. The method of playing a card game of claim 7, wherein the banker hit rules require the banker to take a hit if the value of the banker's hand is 5½ or less and to stand if the value of the banker's hand is 6 or greater.

9. The method of playing a card game of claim 7, further comprising allowing the player to surrender and forfeit one-half of their bet if their initial one-card hand is a five.

10. The method of playing a card game of claim 6, wherein the numerical target is 10½ tens have a value of 10 face cards have a value of ½.

11. The method of playing a card game of claim 10, wherein the banker hit rules require the banker to take a hit if the value of the banker's hand is 6 or less and to stand if the value of the banker's hand is 6½ or greater.

12. The method of playing a card game of claim 5, wherein numbered cards above the integer portion of the numerical target receive the predetermined fractional value.

13. The method of playing a card game of claim 5, wherein numbered cards above the integer portion of the numerical target receive face value.

14. The method of playing a card game of claim 5, wherein numbered cards above the integer portion of the numerical target are not used.

15. The method of playing a card game of claim 1, wherein completing the player's hand further comprises allowing the player surrender if the value of their hand falls within predetermined limits.

16. The method of playing a card game of claim 1, wherein all bets receive a payout equal to the amount bet.

17. The method of playing a card game of claim 1, wherein all winning bets receive a payout equal to the amount bet except the player receives a payout greater than the amount bet when the player wins with a hand having a value equal to the numerical target.

18. A method of playing a card game, comprising the steps of:

accepting a bet from at least one player dealing a player's hand to the player and a banker's hand to the banker, the player's hand consisting of one card dealt face up and the banker's hand consisting of one card dealt face down completing the player's hand, completing the player's hand comprising allowing the player to surrender if the dealt card is a five receiving an election from the player to optionally to receive one or more additional cards wherein the player loses their bet if the value of their hand exceeds 9½, regardless of the value of the banker's hand, wherein the value of a hand is the sum of the values of the cards comprising the hand, wherein Aces have a value of 1, numbered cards two through nine have face value, and tens and face cards have a value of ½ after the player's hand is completed, completing the banker's hand, completing the banker's hand comprising exposing the card dealt to the banker if the initial value of the banker's hand is 5½ or less, dealing additional cards to the banker's hand until the value of the banker's hand is 6 or greater resolving bets according to the following rules:

when the value of the banker's hand exceeds 9½, every player having a hand with a value less than or equal to 9½ wins when the value of the banker's hand and a player's hand are both less than or equal to 9½, the hand with the highest value wins when the value of the banker's hand and a player's hand are equal and less than or equal to 9½, the hand is a tie.

19. A computing device for playing a game, the computing device comprising:

a user input device a display device a processor a memory wherein the processor and the memory comprise circuits and software to perform actions comprising accepting a bet from at least one player dealing a player's hand to the player and a banker's hand to the banker, the player's hand consisting of one card face up and the banker's hand consisting of one card face down completing the player's hand, completing the player's hand comprising receiving an election from the player to optionally receive one or more additional cards after the player's hands is completed, completing the banker's hand, completing the banker's hand comprising exposing the card dealt to the banker face down optionally dealing one or more cards to the banker's hand according to predetermined banker hit rules resolving bets according to the following rules:

if the player receives a hand having a value greater than a predetermined numerical target, the player loses regardless of the value of the banker's hand if the player receives a hand having a value less than or equal to the numerical target and the value of the banker's hand exceeds the numerical target, the player wins when the value of the banker's hand and the player's hand are both less than or equal to the numerical target, the hand with the highest value wins when the value of the banker's hand and the player's hand are equal and less than or equal to the numerical target, the hand is a tie.

20. The computing device of claim 19, wherein the at least one player is a plurality of players a respective player's hand is dealt to each of the plurality of players the respective hands of all of the plurality of players are completed before the banker's hand is completed.

21. The computing device of claim 19, wherein the numerical target is a non-integer value.

22. The computing device of claim 21, wherein the numerical target is equal to the sum of an integer and a fractional portion.

23. The computing device of claim 22, wherein the value of each hand is the sum of the values of the cards dealt to the hand aces have a value of 1 face cards have a predetermined fractional value numbered cards up to the integer portion of the numerical target have face value.

24. The computing device of claim 23, wherein the predetermined fractional value is equal to the fractional portion of the numerical target.

25. The computing device of claim 24, wherein the numerical target is 9½ tens and face cards have a value of ½.

26. The computing device of claim 25, wherein the banker hit rules require the banker to take a hit if the value of the banker's hand is 5½ or less and to stand if the value of the banker's hand is 6 or greater.

27. The computing device of claim 25, further comprising allowing the player to surrender and forfeit one-half of their bet if the initial one-card player's hand is a five.

28. The computing device of claim 24, wherein the numerical target is 10½ tens have a value of 10 face cards have a value of ½.

29. The computing device of claim 28, wherein the banker hit rules require the banker to take a hit if the value of the banker's hand is 6 or less and to stand if the value of the banker's hand is 6½ or greater.

30. The computing device of claim 23, wherein numbered cards above the integer portion of the numerical target receive the predetermined fractional value.

31. The computing device of claim 23, wherein numbered cards above the integer portion of the numerical target receive face value.

32. The computing device of claim 23, wherein numbered cards above the integer portion of the numerical target are not used.

33. The computing device of claim 19, wherein completing the player's hand further comprises allowing the player to surrender if the value of their hand falls within predetermined limits.

34. The computing device of claim 19, wherein all bets receive a payout equal to the amount bet.

35. The computing device of claim 19, wherein all bets receive a payout equal to the amount bet except a player who wins with a hand having a value equal to the numerical target receives a payout greater than the amount bet.

* * * * *